US009093039B2

(12) United States Patent
Oh et al.

(10) Patent No.: US 9,093,039 B2
(45) Date of Patent: Jul. 28, 2015

(54) LIQUID CRYSTAL DISPLAY DEVICE AND METHOD OF DRIVING THE SAME

(71) Applicant: LG Display Co., Ltd., Seoul (KR)

(72) Inventors: Dae-Seok Oh, Paju-si (KR); Yong-Hwa Park, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 102 days.

(21) Appl. No.: 14/053,948

(22) Filed: Oct. 15, 2013

(65) Prior Publication Data

US 2014/0160186 A1 Jun. 12, 2014

(30) Foreign Application Priority Data

Dec. 10, 2012 (KR) ..... 10-2012-0142752

(51) Int. Cl.
*G09G 5/00* (2006.01)
*G09G 3/36* (2006.01)

(52) U.S. Cl.
CPC ..... *G09G 3/3614* (2013.01); *G09G 3/3648* (2013.01); *G09G 2310/0205* (2013.01)

(58) Field of Classification Search
CPC . G09G 3/3607; G09G 3/3614; G09G 3/3648; G09G 2310/0205; G09G 2310/0251; G09G 2310/0243
USPC ..... 345/212, 79, 209, 694
See application file for complete search history.

(56) References Cited

U.S. PATENT DOCUMENTS

2010/0289792 A1* 11/2010 Liao et al. ..... 345/213
2012/0139892 A1* 6/2012 Oh et al. ..... 345/212
2013/0307884 A1* 11/2013 Saitoh et al. ..... 345/690

* cited by examiner

*Primary Examiner* — Kumar Patel
*Assistant Examiner* — Randal Willis
(74) *Attorney, Agent, or Firm* — McKenna Long & Aldridge LLP

(57) ABSTRACT

Disclosed is a liquid crystal display device and a method of driving the same, which prevent image-quality defects due to charge variation. In the method of driving the liquid crystal display device including a pixel consisting of first to third sub-pixels which share one data line and are connected to first to third gate lines, one sub-pixel is turned off on a per frame basis, another sub-pixel is charged with a polarity inverted data voltage for a first charge time including a charge time of the turned-off sub-pixel, and the other sub-pixel is charged with a data voltage having the same polarity as a previous data voltage for a second charge time less than the first charge time. The turned-off sub-pixel, the sub-pixel charged with the polarity inverted data voltage, and the sub-pixel charged with the polarity maintained data voltage alternately vary on a per frame basis.

12 Claims, 7 Drawing Sheets

LIQUID CRYSTAL DISPLAY DEVICE AND METHOD OF DRIVING THE SAME

This application claims the benefit of Korean Patent Application No. 10-2012-0142752, filed on Dec. 10, 2012, which is hereby incorporated by reference as if fully set forth herein.

BACKGROUND OF THE INVENTION

1. Field of the Invention

The present invention relates to a liquid crystal display device, and more particularly to a liquid crystal display device and a method of driving the same, which may prevent image quality defects due to charge variation in a liquid crystal panel having a reduced number of data lines.

2. Discussion of the Related Art

Liquid crystal display devices display an image using electrical and optical properties of liquid crystals. Liquid crystals have anisotropy in which, e.g., refractive indices and dielectric constants are different between the major axis and the minor axis of molecules. The molecular arrangement and optical properties of liquid crystals are easily adjustable. Liquid crystal display devices display an image by varying the arrangement direction of liquid crystal molecules depending on the magnitude of an electric field to adjust transmittance of light passing through a polarizing plate.

A liquid crystal display device includes a liquid crystal panel in which a plurality of pixels is arranged in a matrix form, and drive circuits including a gate driver to drive gate lines of the liquid crystal panel and a data driver to drive data lines of the liquid crystal panel.

To reduce the cost of the liquid crystal display device, it has been contemplated to reduce the number of output channels of the data driver by reducing the number of data lines while maintaining resolution of the liquid crystal panel.

For example, a Double Rate Driving (DRD) model or Triple Rate Driving (TRD) model liquid crystal display device has been proposed, in which two or three horizontally adjacent sub-pixels are connected to a single data line and are sequentially driven by different gate lines, whereby the number of data lines and the number of output channels of the data driver may be reduced to one half or one third compared to existing data lines and output channels. The TRD model liquid crystal display device may reduce the number of data lines and the number of output channels of the data driver more than the DRD model liquid crystal display device, thereby advantageously achieving lower manufacturing costs.

A TRD liquid crystal display device of the related art mainly adopts horizontal 3-dot inversion driving in order to minimize flickering and reduce power consumption. In this case, high-charge sub-pixels, to which a data voltage having the same polarity as a previous data voltage is supplied, and low-charge sub-pixels, to which a data voltage having an inverted polarity opposite to that of a previous data voltage is supplied, may be divided on a per horizontal or vertical line basis or on a per color basis, which may cause image quality defects, such as horizontal or vertical linear spots, due to charge variation.

For example, in the TRD liquid crystal display device of the related art using 3-dot inversion driving, only a data voltage to be supplied to a Red (R) sub-pixel is polarity inverted as compared to a previous data voltage, which results in the low-charge R sub-pixel. Therefore, charge variation between the low-charge R sub-pixel and high-charge Green (G)/Blue (B) sub-pixels causes low-temperature reddish phenomenon.

SUMMARY OF THE INVENTION

Accordingly, the present invention is directed to a liquid crystal display device and a method of driving the same that substantially obviate one or more problems due to limitations and disadvantages of the related art.

An advantage of the present invention is to provide a liquid crystal display device and a method of driving the same, which may prevent image quality defects due to charge variation in a Triple Rate Driving (TRD) model.

Additional advantages, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, a method of driving a liquid crystal display device, the liquid crystal display device including a pixel consisting of first to third sub-pixels of different colors which share one data line and are connected respectively to first to third gate lines, includes turning off one sub-pixel among the first to third sub-pixels on a per frame basis, charging another sub-pixel with a data voltage having an inverted polarity as compared to a previous data voltage supplied through the data line for a first charge time including a charge time of the turned-off sub-pixel, and charging the other sub-pixel with a data voltage having the same polarity as a previous data voltage supplied through the data line for a second charge time less than the first charge time, and alternately varying, on a per frame basis, the turned-off sub-pixel, the sub-pixel charged with the polarity inverted data voltage, and the sub-pixel charged with the polarity maintained data voltage between the first to third sub-pixels.

In accordance with another aspect of the present invention, a liquid crystal display device includes a liquid crystal panel including a pixel consisting of first to third sub-pixels of different colors which share one data line and are connected respectively to first to third gate lines, wherein one sub-pixel among the first to third sub-pixels is turned off on a per frame basis, another sub-pixel is charged with a data voltage having an inverted polarity as compared to a previous data voltage supplied through the data line for a first charge time including a charge time of the turned-off sub-pixel, and the other sub-pixel is charged with a data voltage having the same polarity as a previous data voltage supplied through the data line for a second charge time less than the first charge time, and wherein the liquid crystal display device further includes a drive circuit that alternately varies the turned-off sub-pixel, the sub-pixel charged with the polarity inverted data voltage, and the sub-pixel charged with the polarity maintained data voltage between the first to third sub-pixels on a per frame basis.

The drive circuit may include a data driver to drive the data line, a gate driver to drive the gate lines, and a timing controller to control driving timing of the data driver and the gate driver. The timing controller may generate and output a polarity control signal for polarity inversion of the data voltage per 3H (H being a horizontal sync period) on a per frame basis. In addition, the timing controller may shift polarity inversion timing of the polarity control signal by a 1H period on a per frame basis.

Among first to third data voltages to be supplied respectively to the first to third sub-pixels, the timing controller may be off a next data of a first data, wherein the first data is converted into a first data voltage having a polarity inverted as compared to a previous data voltage in the data driver. In addition, the timing controller may supply the first data to the data driver for a corresponding supply period as well as for an off period of the next data, and may supply a second data for a corresponding supply period, wherein the second data is converted in a second voltage having the same polarity as a previous data voltage in the data driver. The data driver may supply the polarity inverted first data voltage to the data line for 2H, and may supply the polarity maintained second data voltage to the data line for 1H in response to the polarity control signal.

The gate driver may turn off a gate pulse to be applied to one gate line among the first to third gate lines for a corresponding scan period to turn off a corresponding sub-pixel, may apply a first gate pulse, which does not overlap with a previous gate pulse for the first charge time, to another gate line such that a corresponding sub-pixel is charged with the polarity inverted data voltage for the first charge time, and may apply a second gate pulse, which does not overlap with the previous first gate pulse for the second charge time, to the other gate line such that a corresponding sub-pixel is charged with the polarity maintained data voltage for the second charge time. In addition, the gate driver may alternately vary the gate line which the gate pulse is off, another gate line to which the first gate pulse is supplied, and the other gate line to which the second gate pulse is applied between the first to third gate lines on a per frame basis.

The first and second gate pulses may have the same pulse width. The first gate pulse may obtain a pre-charge period of 1H for which the first gate pulse overlaps with the previous gate pulse, and a main-charge period of 2H for which the first gate pulse does not overlap with the previous gate pulse. The second gate pulse may obtain a pre-charge period of 2H for which the second gate pulse overlaps with the previous first gate pulse, and a main-charge period of 1H for which the second gate pulse does not overlap with the previous first gate pulse.

The data voltage to be supplied to the data line may be polarity inverted per 3H. The remaining two sub-pixels among the first to third sub-pixels of each pixel except for the turned-off sub-pixel may have opposite polarities. In addition, the two sub-pixels may have polarities opposite to those of two sub-pixels of each of other vertically and horizontally adjacent pixels. Polarities of the sub-pixels may be inverted on a per frame basis.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, exemplary embodiments of the present invention will be described with reference to FIGS. 1 to 5.

Figure 1:
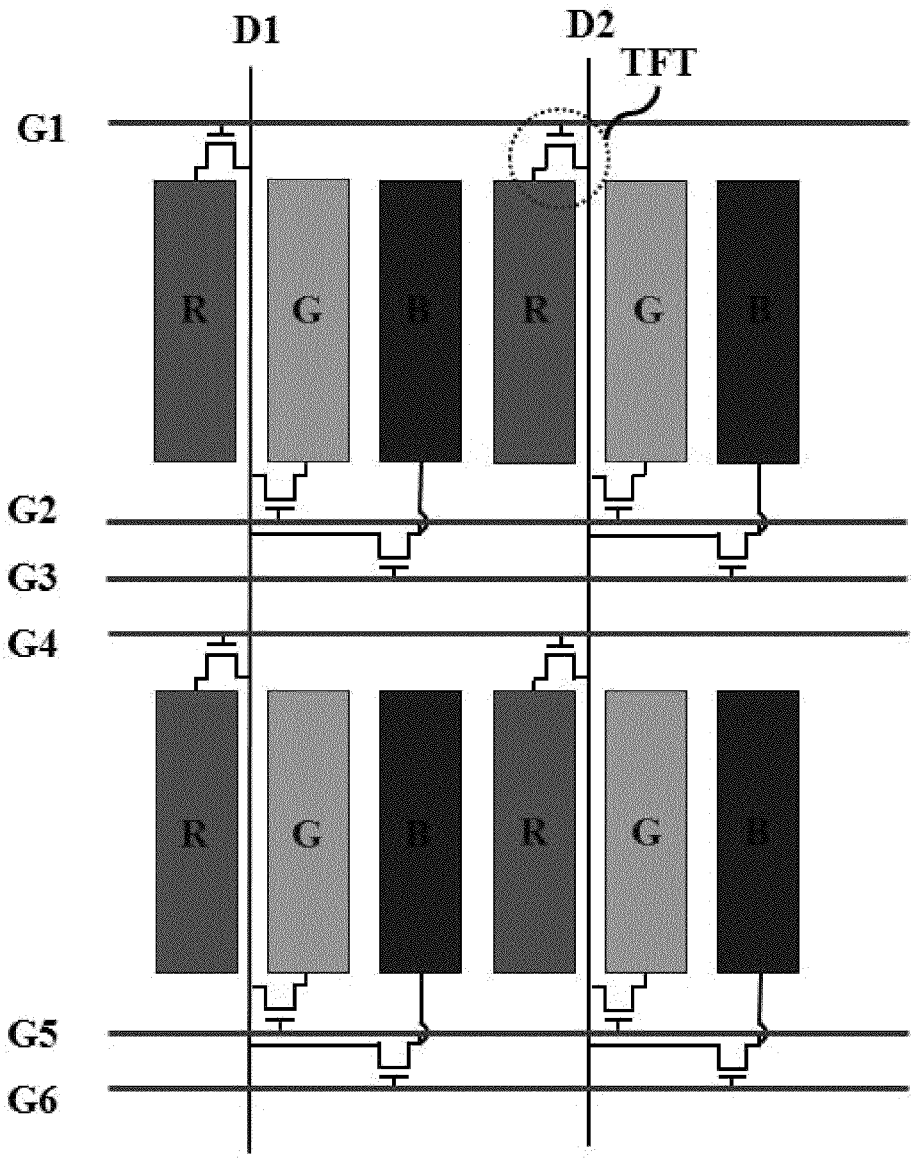
FIG. 1 illustrates a representative pixel configuration of a TRD liquid crystal panel according to the present invention.

FIG. 1 is a view showing a representative pixel configuration of a TRD liquid crystal panel according to the present invention.

A portion of a pixel matrix of the TRD liquid crystal panel exemplarily shown in FIG. 1 includes a plurality of R, G and B sub-pixels having Thin Film Transistors (TFTs) connected respectively to a plurality of gate lines G1~G6 and data lines D1 and D2 crossing each other. In a TRD pixel matrix, R, G and B sub-pixels are alternately iteratively arranged in a horizontal direction, and the sub-pixels of the same color are iteratively arranged in a vertical direction.

In FIG. 1, the R, G and B sub-pixels, which are horizontally arranged to constitute each pixel, share one data line D1 or D2 and are connected respectively to three gate lines G1~G3 or G4~G6 to thereby be sequentially driven. As such, since the TRD liquid crystal panel includes m data lines to drive 3*m* horizontally arranged sub-pixels and 3n gate lines to drive n vertically arranged sub-pixels in order to realize a resolution of m×n pixels (m and n being natural numbers), the number of the gate lines is increased by three times, but the number of the data lines is reduced to one third as compared to a normal configuration.

3k-$2^{nd}$ gate lines G1 and G4 (k being a natural number) are arranged at one of upper and lower sides of the R, G and B sub-pixels, and 3k-$1^{st}$ gate lines G2 and G5 and $3k^{th}$ gate lines G3 and G6 are arranged at the other side of the R, G and B sub-pixels, such that three gate lines are arranged between the vertically adjacent sub-pixels. The data lines D1 and D2 are respectively arranged between the R and G sub-pixels, between the G and B sub-pixels, or between the B and R sub-pixels. As such, the R, G and B sub-pixels, i.e. a row of the R, G and B sub-pixels are arranged in parallel between the adjacent two data lines D1 and D2.

Figure 2:
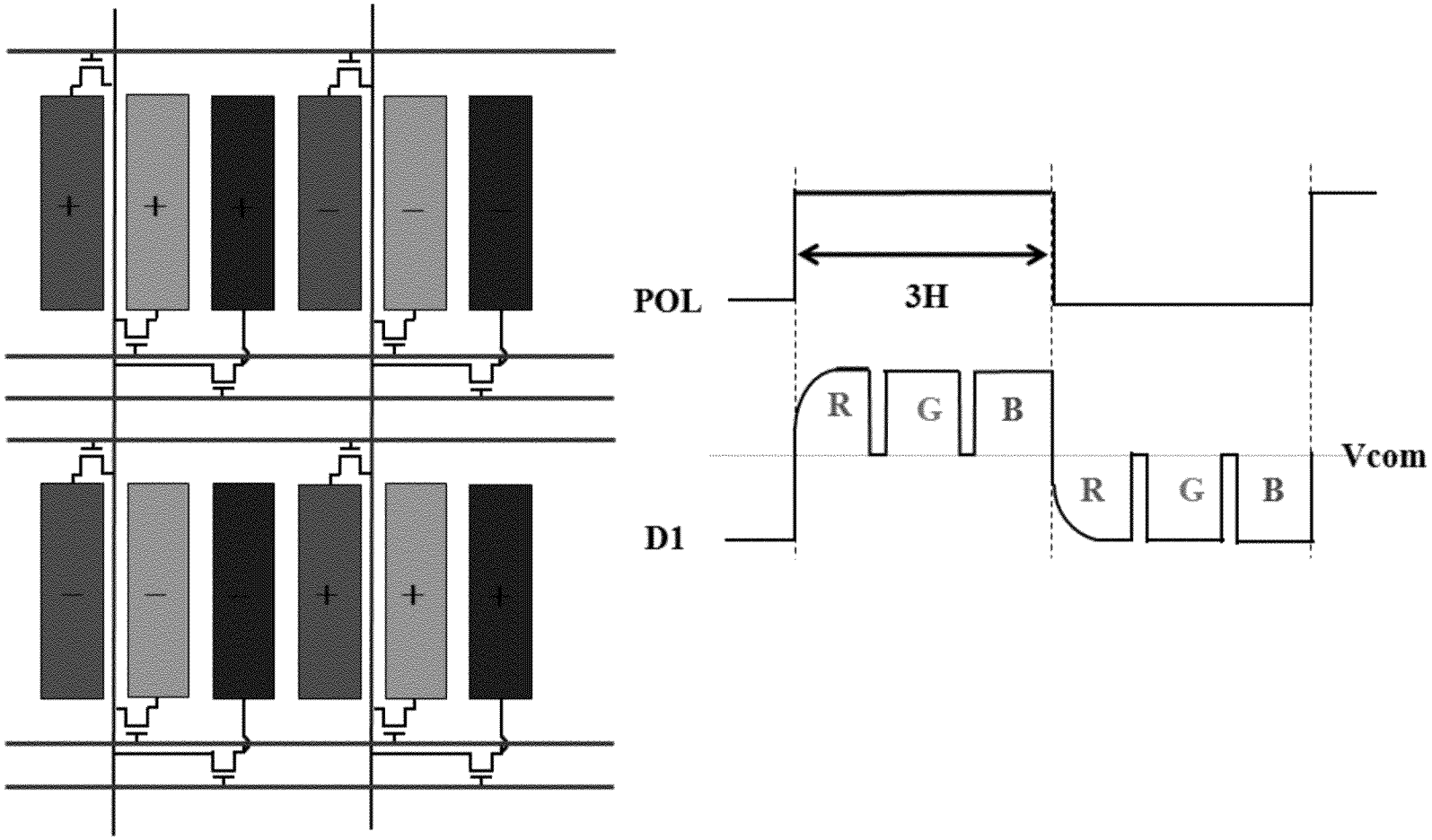
FIG. 2 illustrates a polarity inversion pattern and a driving waveform of a conventional TRD liquid crystal panel.

FIG. 2 is a view showing a polarity inversion pattern and a driving waveform of a conventional TRD liquid crystal panel.

Referring to FIG. 2, according to the related art, R, G and B sub-pixels are sequentially charged with R, G and B data voltages through a single data line D1 or D2 in response to gate pulses of three gate lines G1~G3 or G4~G6 that are sequentially driven. In this case, the R, G and B data voltages to be supplied to the data line D1 are polarity inverted per 3 data voltages, i.e. per 3 dots in response to a polarity control signal POL for polarity inversion per 3H (H being a horizontal synchronization period). Thereby, in the related art, whenever the R data voltage is supplied, the rise (fall) time of the R data voltage is delayed as a polarity of the R data voltage is inverted. Therefore, the R data voltage having a polarity opposite to that of a previous data voltage, which is supplied to a corresponding data line, is charged in small quantity into the R sub-pixel due to an insufficient charge time, whereas G and B data voltages having the same polarity as a previous data voltage, which is supplied to a corresponding data line, are charged in large quantity into the G and B sub-pixels. Consequently, it will be appreciated that charge variation between the low-charge R sub-pixel and the high-charge G and B sub-pixels occur.

Figure 3A:
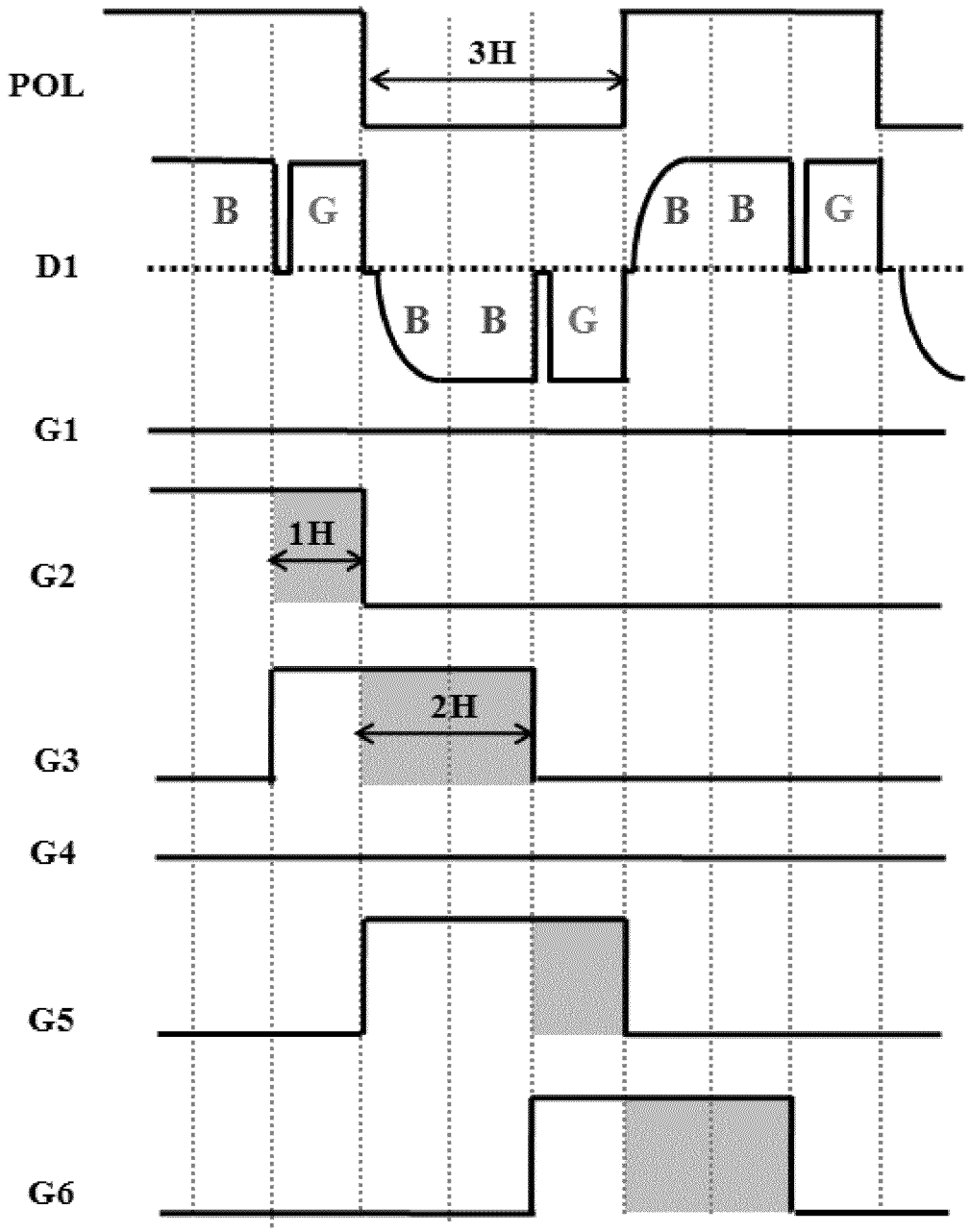
FIGS. 3A to 3C are views showing a driving waveform on a per frame basis according to the present invention for driving of the TRD liquid crystal panel shown in FIG. 1.
Figure 3B:
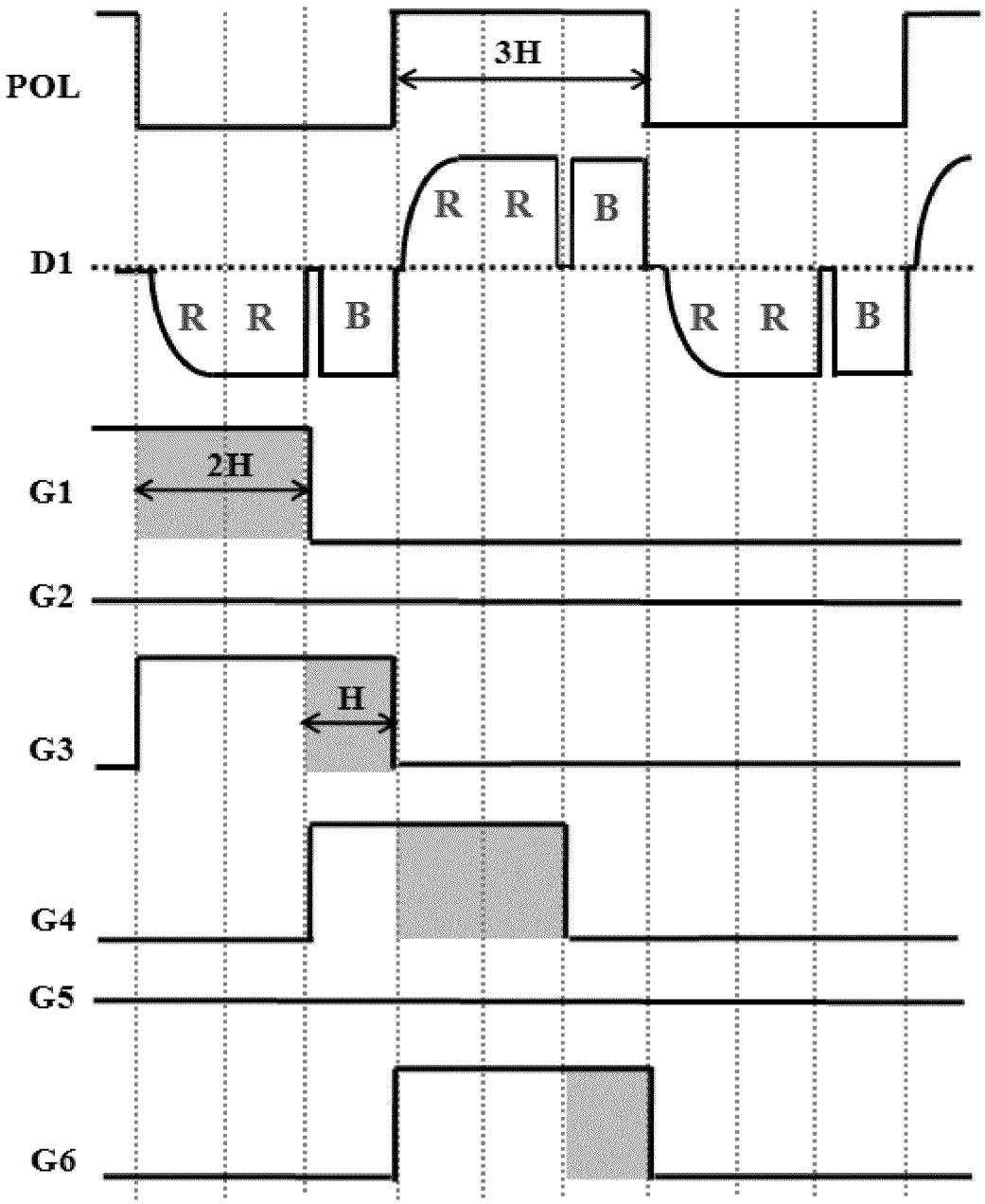
Figure 3C:
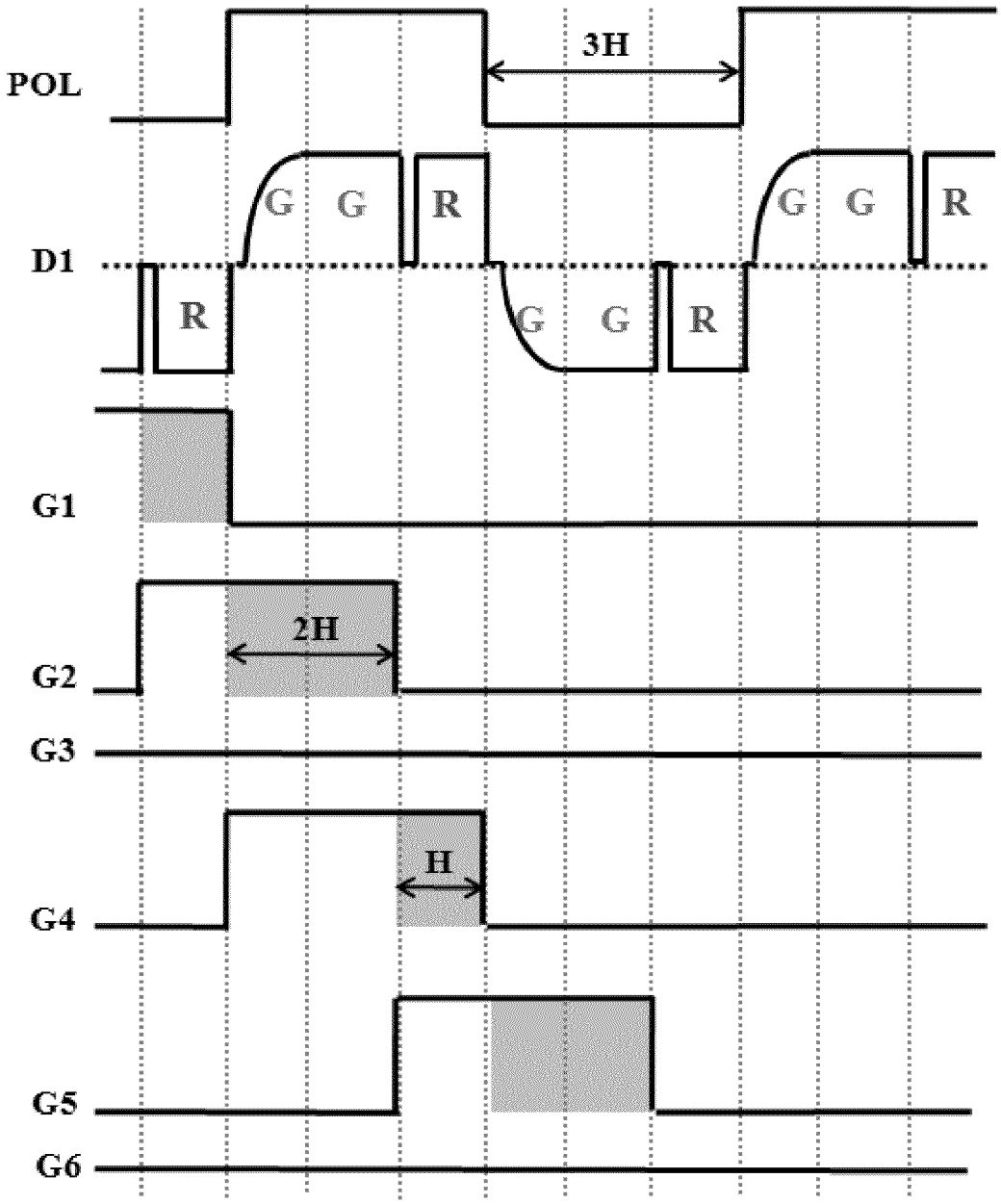

To solve such charge variation due to an insufficient charge time, a TRD liquid crystal display device according to an embodiment of the present invention is devised to increase a charge (supply) time of a polarity inverted data voltage beyond a charge (supply) time of a polarity maintained data voltage via interlaced driving wherein any one of R, G and B data voltages is alternately off on a per frame basis as exemplarily shown in FIGS. 3A to 3C.

FIGS. 3A to 3C are views showing a driving waveform on a per frame basis according to the present invention for driving of the TRD liquid crystal panel shown in FIG. 1.

Referring to FIGS. 3A to 3C, one of R, G and B data voltages supplied to a single data line D1 shared by R, G and B sub-pixels is off on a per frame basis, and a previous data voltage, which is supplied to be polarity inverted, is continuously supplied for an off period of the data voltage. In other words, a data voltage is polarity inverted in response to a polarity control signal POL for polarity inversion per 3H. A next data voltage of the polarity inverted data voltage is off such that the polarity inverted data voltage is supplied for 2H. A data voltage having the same polarity as a previous data voltage is supplied for 1H in the same manner as the related art. In addition, as a polarity inversion timing of the polarity control signal POL is shifted by 1H on a per frame basis, the data, a voltage polarity of which is inverted, and the data to be off alternately vary between the R, G and B data voltages on a per frame basis.

To realize interlaced driving of the R, G and B data voltages, it is off a corresponding gate pulse to be applied to one of the three gate lines G1~G3 or G4~G6, which respectively drive the R, G and B sub-pixels, for a corresponding H period on a per frame basis. The gate line, which the gate pulse is off for the corresponding H period, alternately varies between the three gate lines G1~G3 or G4~G6 on a per frame basis.

The gate pulse, applied to each gate line, has a pulse width of 3H for pre-charge and main-charge, and each gate pulse is applied so as to overlap with an adjacent gate pulse by a 1H or 2H period. The 1H or 2H period, for which each gate pulse overlaps with a previous gate pulse, is a pre-charge period of a corresponding sub-pixel, and a 2H or 1H period, for which each gate pulse does not overlap with a previous gate pulse, is a main-charge period for which the corresponding sub-pixel is charged with a corresponding data voltage. With regard to a gate line connected to a sub-pixel to which a polarity inverted data voltage is supplied, a gate pulse is applied so as to obtain a pre-charge period of 1H for which the gate pulse overlaps with a previous gate pulse, and a main-charge period of 2H for which the gate pulse does not overlap with a previous gate pulse. With regard to a gate line connected to a sub-pixel to which a polarity maintained data voltage is supplied, a gate pulse is applied so as to obtain a pre-charge period of 2H for which the gate pulse overlaps with a previous gate pulse, and a main-charge period of 1H for which the gate pulse does not overlap with a previous gate pulse. As such, a period (2H) for which a corresponding sub-pixel is charged with a polarity inverted data voltage is greater than a period (1H) for which a corresponding sub-pixel is charged with a polarity maintained data voltage.

Referring to FIG. 3A, in a first frame, whenever a B data voltage is supplied to the first data line D1, the B data voltage is polarity inverted in response to the polarity control signal POL for polarity inversion per 3H, and a next R data voltage following the polarity inverted B data voltage is off. Thereby, the polarity inverted B data voltage is supplied for 2H, and a next G data voltage having the same polarity as the previous B data voltage is supplied for 1H.

Additionally, as it is off a gate pulse to be applied to the first gate line G1 or G4 connected to the R sub-pixel, the R sub-pixel is turned off without data charging. As a gate pulse applied to the second gate line G2 or G5 connected to the G sub-pixel has a pre-charge period of 2H and a main-charge period of 1H, the G sub-pixel pre-charges a G data voltage through the data line D1 for the pre-charge period of 21-1 and is charged with the polarity maintained G data voltage from the data line D1 for the main-charge period of 1H. In addition, as a gate pulse applied to the third gate line G3 or G6 connected to the B sub-pixel obtains a pre-charge period of 1H and a main-charge period of 2H, the B sub-pixel pre-charges a voltage through the data line D1 for the pre-charge period of 1H and is charged with the polarity inverted B data voltage from the data line D1 for the main-charge period of 2H.

In this way, it may be possible to prevent charge variation between the B sub-pixel charged with the B data voltage having an inverted polarity as compared to a previous data voltage and the G sub-pixel charged with the G data voltage having the same polarity as the previous B data voltage.

Referring to FIG. 3B, in a second frame, a polarity control signal POL, which has a polarity opposite to that of the polarity control signal POL supplied in the first frame and has a polarity inversion timing shifted by 1H, is supplied. In the second frame, whenever an R data voltage is supplied, the R data voltage is polarity inverted in response to the polarity control signal POL, and a next G data voltage following the polarity inverted R data voltage is off. Thereby, the polarity inverted R data voltage is supplied for 2H, and a next B data voltage having the same polarity as the previous R data voltage is supplied for 1H.

Additionally, as a gate pulse applied to the first gate line G1 or G4 connected to the R sub-pixel obtains a pre-charge period of 1H and a main-charge period of 2H, the R sub-pixel pre-charges a voltage through the data line D1 for the pre-charge period of 1H and is charged with the polarity inverted R data voltage from the data line D1 for the main-charge period of 2H. In this case, since it is off a gate pulse to be applied to the second gate line G2 or G5 connected to the G sub-pixel, the G sub-pixel is turned off without data charging. In addition, as a gate pulse applied to the third gate line G3 or G6 connected to the B sub-pixel obtains a pre-charge period of 2H and a main-charge period of 1H, the B sub-pixel pre-charges a voltage through the data line D1 for the pre-charge period of 2H and is charged with the polarity maintained B data voltage from the data line D1 for the main-charge period of 1H.

In this way, it may be possible to prevent charge variation between the R sub-pixel charged with the R data voltage having an inverted polarity as compared to a previous data voltage and the B sub-pixel charged with the B data voltage having the same polarity as the previous R data voltage.

Referring to FIG. 3C, a polarity control signal POL, which has a polarity opposite to that of the polarity control signal POL supplied in the second frame and has a polarity inversion timing shifted by 1H, is supplied in a third frame. In the third frame, whenever a G data voltage is supplied, the G data voltage is polarity inverted in response to the polarity control signal POL, and a next B data voltage following the polarity inverted G data voltage is off. Thereby, the polarity inverted G data voltage is supplied for 2H, and a next R data voltage having the same polarity as the previous G data voltage is supplied for 1H.

Additionally, as a gate pulse applied to the first gate line G1 or G4 connected to the R sub-pixel obtains a pre-charge period of 2H and a main-charge period of 1H, the R sub-pixel pre-charges a voltage through the data line D1 for the pre-charge period of 2H and is charged with the polarity maintained R data voltage from the data line D1 for the main-charge period of 1H. As a gate pulse applied to the second gate line G2 or G5 connected to the G sub-pixel obtains a pre-charge period of 1H and a main-charge period of 2H, the G sub-pixel undergoes pre-charges a voltage through the data line D1 for the pre-charge period of 1H and is charged with the polarity inverted G data voltage from the data line D1 for the main-charge period of 2H. In this case, as it is off a gate off voltage to be applied to the third gate line G3 or G6 connected to the B sub-pixel, the B sub-pixel is turned off without data charging.

In this way, it may be possible to prevent charge variation between the G sub-pixel charged with the G data voltage having an inverted polarity as compared to a previous data voltage and the R sub-pixel charged with the R data voltage having the same polarity as the previous G data voltage.

Figure 4:
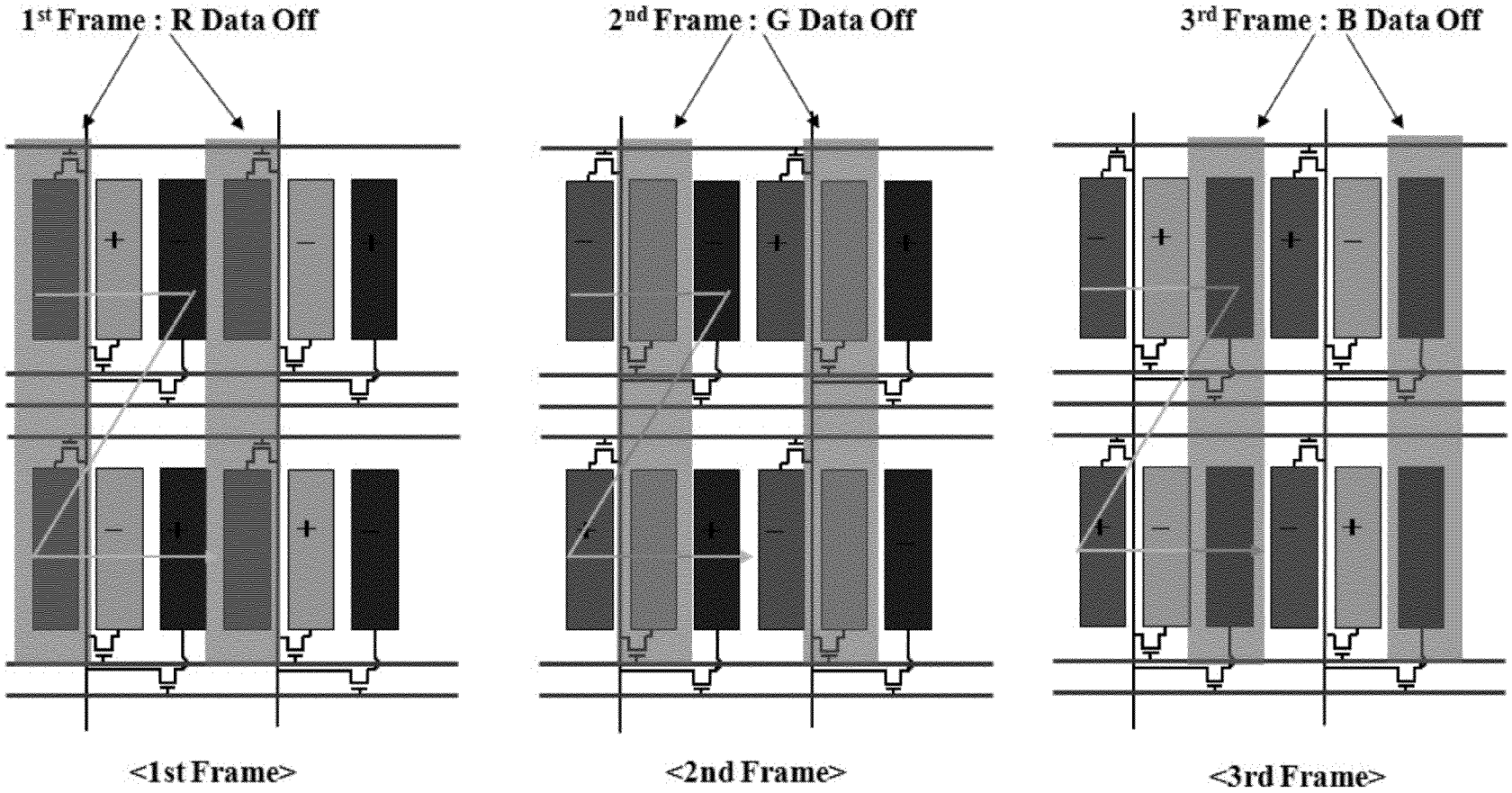
FIG. 4 is a view showing a polarity inversion pattern of a TRD liquid crystal panel on a per frame basis according to an embodiment of the present invention.

FIG. 4 is a view showing a polarity inversion pattern of a TRD liquid crystal panel on a per frame basis according to an embodiment of the present invention.

In the first frame exemplarily shown in FIG. 4, with regard to the R, G and B sub-pixels of each pixel, the R sub-pixel is turned off, and the G and B sub-pixels are charged respectively with G and B data voltages having opposite polarities. In addition, the G and B sub-pixels of each pixel have polarities opposite to those of the G and B sub-pixels of vertically and horizontally adjacent pixels. In the first frame, the B sub-pixel, charged with the B data voltage having an inverted polarity as compared to a previous data voltage, is continuously charged with the B data voltage while the next R sub-pixel is turned off, which ensures a sufficient charge time of the polarity inverted B data voltage. In this way, it may be possible to prevent charge variation between the B sub-pixel charged with the B data voltage having an inverted polarity as compared to a previous data voltage and the G sub-pixel charged with the G data voltage having the same polarity as the previous B data voltage.

In the second frame exemplarily shown in FIG. 4, with regard to the R, G and B sub-pixels of each pixel, the G sub-pixel is turned off and the R and B sub-pixels are charged respectively with R and B data voltages having the same polarity. In addition, the R and B sub-pixels of each pixel have polarities opposite to those of the R and B sub-pixels of vertically and horizontally adjacent pixels. In the second frame, the R sub-pixel, charged with the R data voltage having an inverted polarity as compared to a previous data voltage, is continuously charged with the R data voltage while the next G sub-pixel is turned off, which ensures a sufficient charge time of the polarity inverted R data voltage. In this way, it may be possible to prevent charge variation between the R sub-pixel charged with the R data voltage having an inverted polarity as compared to a previous data and the B sub-pixel charged with the B data voltage having the same polarity as the previous R data voltage.

In the third frame exemplarily shown in FIG. 4, with regard to the R, G and B sub-pixels of each pixel, the B sub-pixel is turned off and the R and G sub-pixels are charged respectively with R and G data voltages having opposite polarities. In addition, the R and G sub-pixels of each pixel have polarities opposite to those of the R and G sub-pixels of vertically and horizontally adjacent pixels. In the third frame, the G sub-pixel, charged with the G data voltage having an inverted polarity as compared to a previous data voltage is continuously charged with the G data voltage while the next B sub-pixel is turned off, which ensures a sufficient charge time of the polarity inverted G data voltage. In this way, it may be possible to prevent charge variation between the G sub-pixel charged with the G data voltage having an inverted polarity as compared to a previous data voltage and the R sub-pixel charged with the R data voltage having the same polarity as the previous G data voltage.

Referring to FIG. 4, it will be appreciated that, among first to third sub-pixels of each pixel, the remaining two sub-pixels except for one off sub-pixel have opposite polarities and also have polarities opposite to those of two sub-pixels of vertically and horizontally adjacent pixels, and are polarity inverted on a per frame basis.

As described above, the TRD liquid crystal display device and the method of driving the same according to the embodiments of the present invention may increase a charge time of a polarity inverted data voltage such that the polarity inverted data voltage is continuously charged for an off period of a next off data voltage via interlaced driving wherein any one of R, G and B data voltages is alternately turned off on a per frame basis, which may ensure a sufficient charge time of the polarity inverted data voltage. In this way, it may be possible to prevent charge variation between a sub-pixel charged with a data voltage having an inverted polarity as compared to a previous data voltage and a sub-pixel charged with a data voltage having the same polarity as a previous data, thereby preventing image quality defects due to charge variation.

Figure 5:
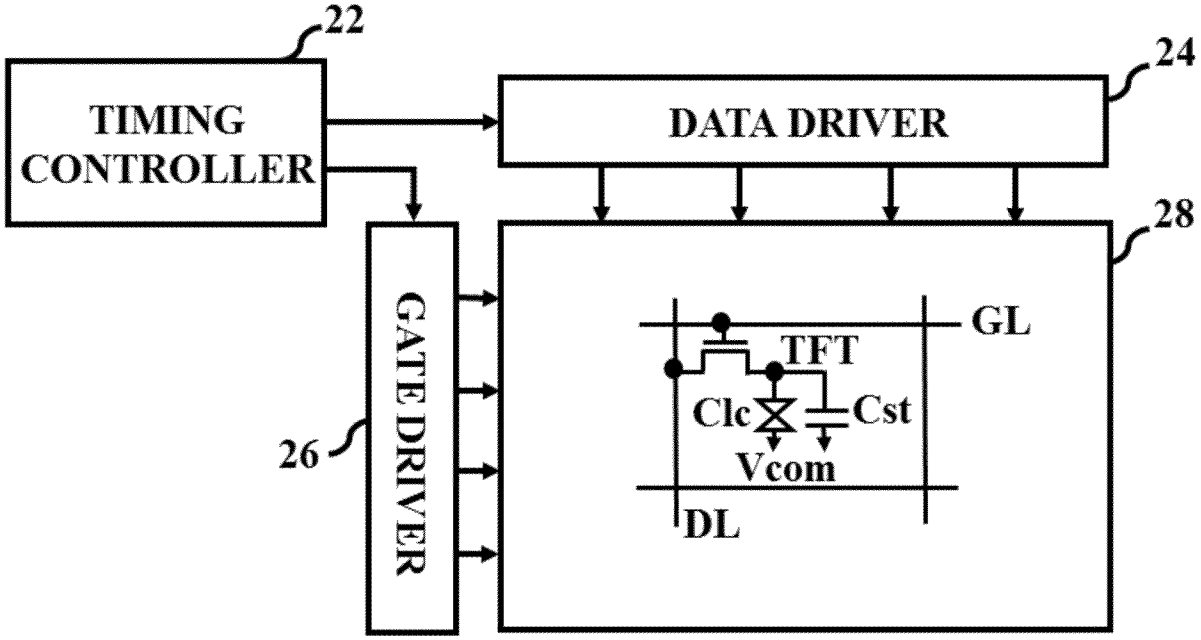
FIG. 5 is a block diagram schematically showing a TRD liquid crystal display device according to an embodiment of the present invention.

FIG. 5 is a block diagram schematically showing a TRD liquid crystal display device according to an embodiment of the present invention.

The liquid crystal display device exemplarily shown in FIG. 5 includes a liquid crystal panel 28, a data driver 24 and a gate driver 26 to drive the liquid crystal panel 28, and a timing controller 22.

The timing controller 22 receives a plurality of sync signals at least including a dot-clock and a data-enable signal as well as R, G and B data voltages supplied from an external source.

The timing controller 22 generates data control signals to control driving timing of the data driver 24 and gate control signals to control driving timing of the gate driver 26 using an external sync signal. The data control signals include a source start pulse and a source sampling clock to control latching of a data signal, a polarity control signal POL to control a polarity of a data signal, and a source output enable signal to control an output period of a data signal, for example. The gate control signals include a gate start pulse and a gate shift clock to control scanning of a gate signal, and a gate output enable signal to control an output period of a gate signal, for example.

The timing controller 22 corrects data input from an external source using various data processing methods to achieve improved image quality or reduced power consumption. For example, the timing controller 22 may output overdriving data by correcting input data into the overdriving data using an overshoot value or undershoot value that is selected from a look-up table according to a data difference between adjacent frames in order to enhance a response speed of liquid crystals. In addition, the timing controller 22 may analyze brightness of input data, correct data based on the analyzed brightness, and control brightness of a backlight unit (not shown), in order to achieve an enhanced contrast ratio and reduced power consumption.

In particular, the timing controller 22 performs data alignment suitable for interlaced driving wherein any one of R, G and B data is alternately off on a per frame basis and maintains a previous data while the corresponding data is off, and transmits the result to the data driver 24. More specifically, any one of R, G and B data voltage is polarity inverted as compared to a previous data voltage in response to a polarity control signal POL for polarity inversion per 3H in the data driver 24. The timing controller 22 turns off a next data of first data, wherein the first data is converted into a first data voltage having a polarity inverted as compared to a previous data voltage in the data driver 24, and supplies the first data to the data driver 24 for a corresponding supply period as well as an off period of the next data. Also, the timing controller 22 supplies a second data for a corresponding supply period, wherein the second data is converted into a second data voltage having the same polarity as a previous data voltage in the data driver 24. In addition, the timing controller 22 alternately varies the off data, the first data, and the second data between the R, G and B data voltages on a per frame basis, and supplies the data voltages to the data driver 24.

The data driver 24 supplies the R, G and B data voltages from the timing controller 22 to the plurality of data lines DL of the liquid crystal panel 28 in response to the data control signal from the timing controller 22. The data driver 24 converts digital data input from the timing controller 22 into a positive/negative analog data voltage in response to the polarity control signal POL using a gamma voltage, and supplies the data voltage to the data lines DL whenever the respective gate lines GL are driven.

The data driver 24 supplies B and G data voltages, R and B data voltages, or G and R data voltages, which are polarity inverted per 3H in response to the polarity control signal POL for polarity inversion per 3H, to each data line. In this case, the data driver 24 supplies the first data voltage having an inverted polarity as compared to a previous data voltage for 2H and the second data voltage having the same polarity as a previous data for 1H to each data line.

The data driver 24 includes at least one data Integrated Circuit (IC) mounted on a circuit film, such as a Tape Carrier Package (TCP), a Chip On Film (COF), a Flexible Print Circuit (FPC), etc, which may be attached to the liquid crystal panel 28 in a Tape Automatic Bonding (TAP) manner, or may be mounted on the liquid crystal panel 28 in a Chip On Glass (COG) manner.

The gate driver 26 sequentially drives the gate lines GL of the liquid crystal panel 28 in response to the gate control signal from the timing controller 22. The gate driver 26 applies a gate pulse of a gate-on voltage to each gate line GL for each scan period and a gate off voltage to each gate line GL for the remaining periods.

In particular, to realize interlaced driving of the R, G and B data voltages, the gate driver 26 turns off a gate pulse to be applied to one gate line among three gate lines GL3*k*-2, GL3*k*-1 and GL3*k* that respectively drive the R, G and B sub-pixels on a per frame basis, and alternately varies one gate line among the three gate lines GL3*k*-2, GL3*k*-1 and GL3*k*, to which the gate pulse is off to applied, on a per frame basis.

In addition, the gate driver 26 applies each gate pulse having a pulse width of 3H such that the gate pulse overlaps with an adjacent gate pulse for 1H or 2H. More specifically, the gate driver 26 applies a gate pulse, which has a pre-charge period of 1H for which the gate pulse overlaps with a previous gate pulse and a main-charge period of 2H for which the gate pulse does not overlap with a previous gate pulse, to a gate line connected to a sub-pixel to which a polarity inverted data voltage is supplied, and supplies a gate pulse, which has a pre-charge period of 2H for which the gate pulse overlaps with a previous gate pulse and a main-charge period of 1H for which the gate pulse does not overlap with a previous gate pulse, to a gate line connected to a sub-pixel to which a polarity maintained data voltage is supplied.

The aforementioned gate driver 26 includes at least one gate IC mounted on a circuit film, such as a TCP, a COF, a FPC, etc, which may be attached to the liquid crystal panel 28 in a TAP manner, or may be mounted on the liquid crystal panel 28 in a COG manner. Alternatively, the gate driver 26 may be formed on a thin film transistor substrate and be mounted in the liquid crystal panel 28 via the same process as a thin film transistor array of the liquid crystal display panel 28 in a Gate In Panel (GIP) manner.

The liquid crystal panel 28 includes a color filter substrate provided with a color filter array, a Thin Film Transistor (TFT) substrate provided with a TFT array, a liquid crystal layer between the color filter substrate and the TFT substrate, and polarizing plates attached respectively to outer surfaces of the color filter substrate and the TFT substrate. The liquid crystal panel 28 displays an image via the TRD pixel matrix as exemplary shown in FIG. 1. Each sub-pixel includes a TFT connected to a gate line GL and a data line DL, and a liquid crystal capacitor Clc and a storage capacitor Cst connected in parallel to the TFT. The liquid crystal capacitor Clc is charged with a difference voltage between a data voltage signal supplied to a pixel electrode through the TFT and a common voltage Vcom applied to a common electrode, and drives liquid crystals according to the charged voltage, thereby adjusting transmittance of light. The storage capacitor Cst stably maintains the voltage charged in the liquid crystal capacitor Clc. The liquid crystal layer is driven by a vertical electric field, such as a Twisted Nematic (TN) mode or a Vertical Alignment (VA) mode, or is driven by a horizontal electric field, such as an In-Plane Switching (IPS) mode or a Fringe Field Switching (FFS) mode.

As is apparent from the above description, in a TRD liquid crystal display apparatus and a method of driving the same according to the embodiments of the present invention, via interlaced driving of R, G and B data voltages corresponding respectively to R, G and B sub-pixels that are connected to the same data line and are sequentially driven, any one of the R, G and B data voltages is alternately turned off on a per frame basis, and a previous supplied polarity inverted data voltage is continuously supplied for an off period of a next off data voltage, which may result in a greater charge period of the data voltage having an inverted polarity as compared to a previous data voltage than a charge period of a data voltage having the same polarity as a previous data voltage.

Accordingly, the TRD liquid crystal display apparatus and the method of driving the same according to the present invention may prevent charge variation between a sub-pixel charged with a data voltage having an inverted polarity as a previous data voltage and a sub-pixel charged with a data voltage having the same polarity as a previous data voltage on the basis of each data line, thereby preventing image quality defects due to charge variation.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display device, the liquid crystal display device comprising a pixel consisting of first to third sub-pixels of different colors which share one data line and are connected respectively to first to third gate lines, the method comprising:

turning off one sub-pixel among the first to third sub-pixels on a per frame basis, charging another sub-pixel with a data voltage having an inverted polarity as compared to a previous data voltage supplied through the data line for a first charge time including a charge time of the turned-off sub-pixel, and charging the other sub-pixel with a data voltage having the same polarity as a previous data voltage supplied through the data line for a second charge time less than the first charge time; and alternately varying, on a per frame basis, the turned-off sub-pixel, the sub-pixel charged with the polarity inverted data voltage, and the sub-pixel charged with the polarity maintained data voltage between the first to third sub-pixels.

2. The method according to claim 1, wherein:

the data voltage is polarity inverted per 3H (H being a horizontal sync period) on a per frame basis in response to a polarity control signal, and polarity inversion timing of the polarity control signal is shifted by a 1H period on a per frame basis.

3. The method according to claim 2, wherein:

among first to third data voltages to be supplied respectively to the first to third sub-pixels, one data voltage is polarity inverted as compared to a previous data voltage in response to the polarity control signal, and a next data voltage following the polarity inverted data voltage is turned off such that the polarity inverted data voltage is continuously supplied for an off period of the corresponding data voltage.

4. The method according to claim 3, wherein:

a gate pulse is off to be applied to one gate line among the first to third gate lines for a corresponding scan period to turn off a corresponding sub-pixel, a first gate pulse, which does not overlap with a previous gate pulse for the first charge time, is applied to another gate line such that a corresponding sub-pixel is charged with the polarity inverted data voltage for the first charge time, a second gate pulse, which does not overlap with the previous first gate pulse for the second charge time, is applied to the other gate line such that a corresponding sub-pixel is charged with the polarity maintained data voltage for the second charge time, and the gate line which the gate pulse is off, another gate line to which the first gate pulse is supplied, and the other gate line to which the second gate pulse is applied alternately vary between the first to third gate lines on a per frame basis.

5. The method according to claim 4, wherein the first and second gate pulses have the same pulse width, wherein the first gate pulse obtains a pre-charge period of 1H for which the first gate pulse overlaps with the previous gate pulse, and a main-charge period of 2H for which the first gate pulse does not overlap with the previous gate pulse, and wherein the second gate pulse obtains a pre-charge period of 2H for which the second gate pulse overlaps with the previous first gate pulse, and a main-charge period of 1H for which the second gate pulse does not overlap with the previous first gate pulse.

6. The method according to claim 5, wherein the data voltage to be supplied to the data line is polarity inverted per 3H, and wherein the remaining two sub-pixels among the first to third sub-pixels of each pixel except for the turned-off sub-pixel have opposite polarities, and have polarities opposite to those of two sub-pixels of each of other vertically and horizontally adjacent pixels, and polarities of the sub-pixels are inverted on a per frame basis.

7. A liquid crystal display device comprising:

a liquid crystal panel including a pixel consisting of first to third sub-pixels of different colors which share one data line and are connected respectively to first to third gate lines, wherein one sub-pixel among the first to third sub-pixels is turned off on a per frame basis, another sub-pixel is charged with a data voltage having an inverted polarity as compared to a previous data voltage supplied through the data line for a first charge time including a charge time of the turned-off sub-pixel, and the other sub-pixel is charged with a data voltage having the same polarity as a previous data voltage supplied through the data line for a second charge time less than the first charge time; and a drive circuit that alternately varies the turned-off sub-pixel, the sub-pixel charged with the polarity inverted data voltage, and the sub-pixel charged with the polarity maintained data voltage between the first to third sub-pixels on a per frame basis.

8. The device according to claim 7, wherein the drive circuit includes:

a data driver to drive the data line;

a gate driver to drive the gate lines; and a timing controller to control driving timing of the data driver and the gate driver, and wherein:

the timing controller generates and outputs a polarity control signal for polarity inversion of the data voltage per 3H (H being a horizontal sync period) on a per frame basis, and the timing controller shifts polarity inversion timing of the polarity control signal by a 1H period on a per frame basis.

9. The device according to claim 8, wherein, among first to third data voltages to be supplied respectively to the first to third sub-pixels, the timing controller:

turns off a next data of a first data, wherein the first data is converted into a first data voltage having a polarity inverted as compared to a previous data voltage in the data driver, supplies the first data to the data driver for a corresponding supply period as well as for an off period of the next data, and supplies a second data for a corresponding supply period, wherein the second data is converted into a second data voltage having the same polarity as a previous data voltage in the data driver, and wherein the data driver supplies the polarity inverted first data voltage to the data line for 2H, and supplies the polarity maintained second data voltage to the data line for 1H in response to the polarity control signal.

10. The device according to claim 8, wherein the gate driver:

turns off a gate pulse to be applied to one gate line among the first to third gate lines for a corresponding scan period to turn off a corresponding sub-pixel, applies a first gate pulse, which does not overlap with a previous gate pulse for the first charge time, to another gate line such that a corresponding sub-pixel is charged with the polarity inverted data voltage for the first charge time, applies a second gate pulse, which does not overlap with the previous first gate pulse for the second charge time, to the other gate line such that a corresponding sub-pixel is charged with the polarity maintained data voltage for the second charge time, and alternately varies the gate line which the gate pulse is off, another gate line to which the first gate pulse is supplied, and the other gate line to which the second gate pulse is applied between the first to third gate lines on a per frame basis.

11. The device according to claim 10, wherein:

the first and second gate pulses have the same pulse width, the first gate pulse obtains a pre-charge period of 1H for which the first gate pulse overlaps with the previous gate pulse, and a main-charge period of 2H for which the first gate pulse does not overlap with the previous gate pulse, and the second gate pulse obtains a pre-charge period of 2H for which the second gate pulse overlaps with the previous first gate pulse, and a main-charge period of 1H for which the second gate pulse does not overlap with the previous first gate pulse.

12. The device according to claim 11, wherein:

the data voltage to be supplied to the data line is polarity inverted per 3H, and the remaining two sub-pixels among the first to third sub-pixels of each pixel except for the turned-off sub-pixel have opposite polarities, and have polarities opposite to those of two sub-pixels of each of other vertically and horizontally adjacent pixels, and polarities of the sub-pixels are inverted on a per frame basis.

* * * * *